US007216774B2

(12) United States Patent
Mizuta et al.

(10) Patent No.: US 7,216,774 B2
(45) Date of Patent: May 15, 2007

(54) CRANE

(75) Inventors: Tokihiko Mizuta, Akashi (JP); Osamu Toudou, Akashi (JP); Keisuke Fukumoto, Akashi (JP); Eiji Miya, Akashi (JP); Yasuhiko Murayama, Akashi (JP)

(73) Assignee: Kobelco Cranes Co., Ltd., Tokyo (JP)

( * ) Notice: Subject to any disclaimer, the term of this patent is extended or adjusted under 35 U.S.C. 154(b) by 290 days.

(21) Appl. No.: 10/967,135

(22) Filed: Oct. 19, 2004

(65) Prior Publication Data

US 2005/0098523 A1 May 12, 2005

(30) Foreign Application Priority Data

Oct. 24, 2003 (JP) ..... 2003-365235

(51) Int. Cl.
*B66C 23/34* (2006.01)

(52) U.S. Cl. ..... 212/295; 212/298; 212/299

(58) Field of Classification Search ..... 212/295, 212/298–300, 239–240, 262
See application file for complete search history.

(56) References Cited

U.S. PATENT DOCUMENTS 2,443,306 A * 6/1948 De Cuir ..... 212/299
3,037,641 A * 6/1962 Potter et al. ..... 212/295
3,072,265 A 1/1963 Nickles
3,176,854 A 4/1965 Brown
3,252,585 A * 5/1966 Wieschel ..... 212/295
3,664,516 A * 5/1972 Goudy ..... 212/297
6,536,615 B2 3/2003 Nishikino et al.
6,702,131 B2 3/2004 Hanamoto

FOREIGN PATENT DOCUMENTS

DE 1 016 916 10/1957
EP 0 048 076 A1 * 3/1982

OTHER PUBLICATIONS

Patent Abstracts of Japan, JP 11-011874, Jan. 19, 1999.

* cited by examiner

*Primary Examiner*—Thomas J Brahan
(74) *Attorney, Agent, or Firm*—Oblon, Spivak, McClelland, Maier & Neustadt, P.C.

(57) ABSTRACT

The present invention provides a crane where a spreader retainer is disposed on a rear surface of an extreme end of the lowest boom portion used both for a tower boom and a normal boom, a distance between an upper spreader, which constitutes a boom raising/lowering apparatus, and a lower spreader at the maximum boom raise angle and the length of the lowest boom portion are set such that the upper spreader can be lowered to the position of the spreader retainer if the boom raising/lowering apparatus lays the boom on the ground, and a boom raising/lowering rope is then loosened for disassembly of either the tower or normal boom. Consequently, the upper spreader can be lowered to the position of the spreader retainer on the lowest boom portion when the boom is disassembled either for the tower crane or normal crane specification.

2 Claims, 2 Drawing Sheets

CRANE

BACKGROUND OF THE INVENTION

1. Field of the Invention

The present invention relates to a crane whose lowest boom of a boom can be used both for a tower crane and a normal crane.

2. Description of the Related Art

In general, in a crane whose lowest boom portion of the boom which consists of several boom portions is used both for the tower crane and the standard crane (hereinafter usually referred to as a normal crane), the respective minimum distances between spreaders (distance between upper and lower spreaders) Sa and Sb are determined when the boom is raised maximally while the tower crane is considered as a standard, and the distances Sa and Sb are set approximately equal both for the cranes.

However, the maximum boom raise angle of the boom depends on the respective cranes, and thus, the distance is longer for the tower crane, and shorter for the normal crane when the boom is laid on the ground.

Consequently, if an upper spreader is lowered on a rear surface of the boom, the spreader is lowered on a second boom exceeding beyond the lowest boom.

As a result, when the boom is disassembled for the tower crane, it is necessary to relocate the upper spreader which has bee lowered on the second boom to a spreader retainer of the lowest boom.

In addition, when the boom is assembled, it is necessary to relocate the upper spreader from the spreader retainer to a position on the second boom where a boom guyline can be connected.

For the relocation of the upper spreader, there are required employment of another crane, maintenance of a boom raising/lowering rope at a proper tension at the same time, and the like, and this operation is thus very troublesome. Consequently, overall work efficiency of the assembly/disassembly of the boom decreases.

SUMMARY OF THE INVENTION

It is an objective of the present invention to provide a crane where an upper spreader can be directly lowered on a spreader retainer of the lowest boom either for a tower or normal crane when a boom is disassembled.

The crane according to the present invention has the following principle constitution.

Namely, the crane according to the present invention is comprised of a base machine, a boom pivotedly attached to the base machine in such a manner that the boom is raised and lowered, and a boom raising/lowering apparatus that raises/lowers the boom. A tower boom for a tower crane specification, or a normal boom with a maximum raising angle of the boom smaller than that of the tower boom for a normal crane specification is respectively attached as the boom. A spreader retainer is attached on a rear surface of a lowest boom portion of the boom used both for the tower boom and the normal boom in common. The boom raising/lowering apparatus is comprised of a gantry, a lower spreader provided on a top of the gantry, an upper spreader disposed closer to an extreme end of the boom than the lower spreader, and a boom raising/lowering rope wound between the upper spreader and the lower spreader. In the crane having the above principle constitution, the distance between both the spreaders is S1 when the boom is maximally raised for the tower crane specification, and S2 when the boom is maximally raised for the normal crane specification, the length of the lowest boom portion is L, and S1, S2, and L are set such that the upper spreader is lowered to the position of the spreader retainer if the boom raising/lowering apparatus lays the boom on the ground for assembling/disassembling the boom for either of the specifications.

According to the present invention, since the distances between the spreaders S1 and S2, and the length of the lowest boom portion L are set such that the upper spreader is lowered to the position of the spreader retainer if the boom raising/lowering apparatus lays the boom on the ground either for the tower crane or the normal crane, it is not necessary to relocate the upper spreader from the second boom to the lowest boom portion for the tower crane.

As a result, when the tower crane is assembled/disassembled, it is possible to eliminate the troublesome operation where an additional crane is used to relocate the upper spreader between the second boom portion and the lowest boom portion while the tension of the boom raising/lowering rope is being observed. Consequently, it is possible to significantly simplify the assembly/disassembly of the boom.

DESCRIPTION OF THE PREFERRED EMBODIMENTS

A crane according to the present invention has a principle constitution including a base machine, a boom attached to the base machine for being raised and lowered, and a boom raising/lowering apparatus that raises/lowers the boom. A tower boom for a normal crane specification, or a normal boom with the maximum raise angle of the boom smaller than that of the tower boom for a normal crane specification is attached as the boom. The boom raising/lowering apparatus is comprised of a gantry, a lower spreader provided on a top of the gantry, an upper spreader, and a boom raising/lowering rope wound between the upper spreader and the lower spreader. A spreader retainer is attached on a rear surface of the lowest boom used both for the tower boom and the normal boom. When the boom is assembled/disassembled, the lowest boom is raised/lowered by the boom raising/lowering apparatus while the upper spreader is retained by the spreader retainer. The distance between both the spreaders is S1 when the boom is maximally raised for the tower crane specification, and S2 when the boom is maximally raised for the normal crane specification, the length of the lowest boom is L, and S1, S2, and L are set such that the upper spreader is lowered to the position of the spreader retainer if the boom raising/lowering apparatus lays the boom on the ground for either of the tower crane and normal crane specifications.

A crane according to the present invention, compared with a crane, wherein the length of the lowest boom is La for the both specifications, and spreader distances Sa and Sb corresponding to the respective specifications are approximately equal to each other, S1, S2, and L satisfy the following conditions:

(i) S1 and Sa are approximately the same;

(ii) S2 is larger than Sa and Sb; and (iii) L is larger than La.

A description will now be given of an embodiment of the present invention with reference to FIGS. 1 to 3.

Figure 1:
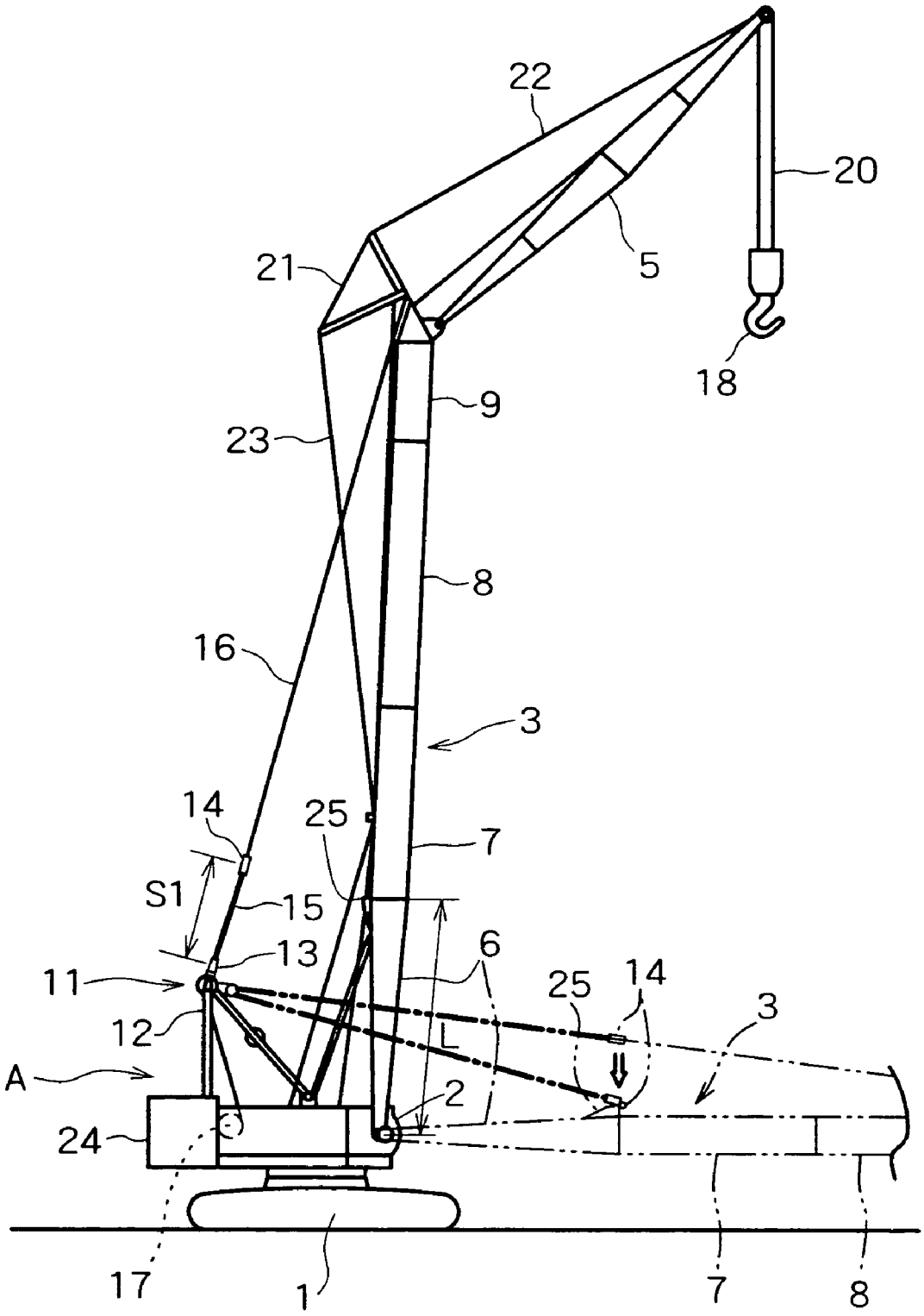
FIG. 1 is a schematic side view of a tower crane according to an embodiment of the present invention.
Figure 2:
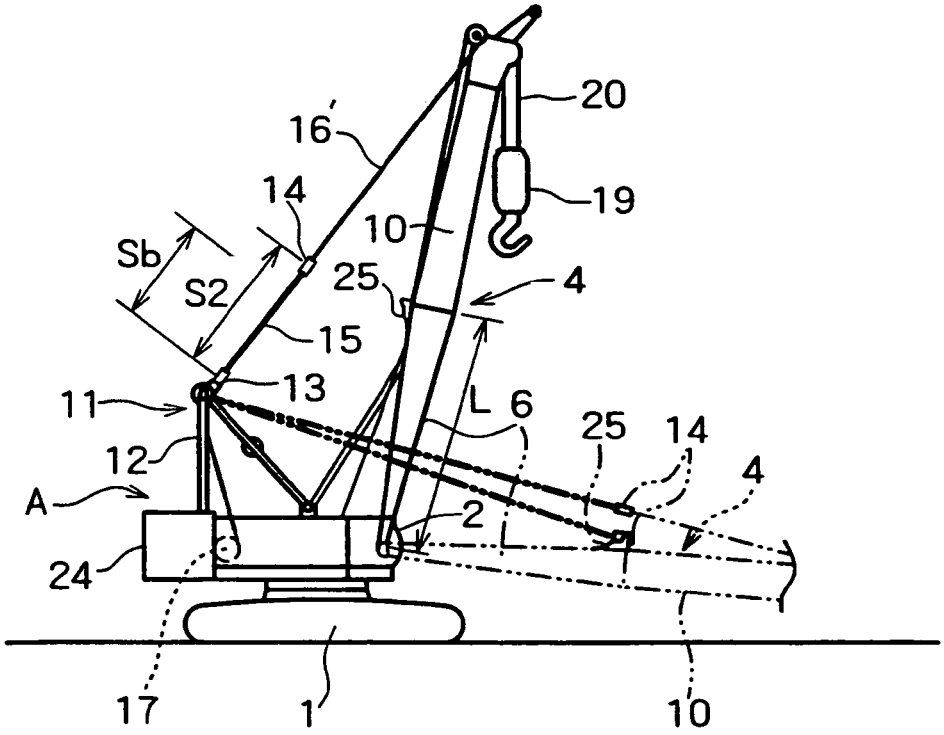
FIG. 2 is a schematic side view of a normal crane according to the embodiment of the present invention.

FIG. 1 and FIG. 2 respectively show a tower crane and a normal crane according to the embodiment.

Both of the cranes use a common base machine A including a crawler type lower traveling body 1 and an upper rotating body 2. A tower boom 3 or a normal boom (normal type boom) 4 is attached to a front section of the upper rotating body 2 respectively for the tower crane or the normal crane.

As the tower crane, a jib 5 extends from a extreme end of the tower boom 3, and an operation is generally carried out by raising/lowering the jib 5 while the tower boom 3 is maintained to a constant angle (approximately 90°).

Alternatively, as the normal crane, an operation is generally carried out by raising/lowering the normal boom 4. In the operation, the maximum boom raise angle is limited to a value smaller than that of the tower boom 3 (80°, for example).

FIG. 1 shows an example where the tower boom 3 is constructed by using the lowest boom 6 as a first boom, and sequentially joining second to forth booms 7, 8, and 9 thereto. FIG. 2 shows an example where the normal boom 4 is constructed by using the lowest boom 6 as a lower boom, and joining an upper boom 10 thereto. It should be noted that the number of the booms joined to the lowest boom 6 may be variously selected/changed according to a required lifting height.

The boom raising/lowering apparatus 11 which raises/lowers the tower boom 3 and normal boom 4 includes a gantry 12 upwardly provided on the upper rotating body 2, a lower spreader 13 provided on a top of the gantry 12, an upper spreader 14, and a boom raising/lowering rope 15 wound between respective sheaves of the lower and upper spreaders 13, 14. The upper spreader 14 is connected to a boom extreme end through a boom guyline 16. The booms 3, 4 are raised/lowered by winding/rewinding the boom raising/lowering rope 15 by means of a raising/lowering winch 17 in this configuration.

In FIGS. 1 and 2, reference numeral 18 denotes a suspension hook suspended down from a extreme end of the jib 5 in the tower crane; 19, a suspension hook suspended down from a extreme end of the boom 4; 20, a winding rope which raises/lowers the suspension hook 18 or 19 on either of the cranes; 21, a jib raising/lowering strut; 22, a jib guyline; 23, a jib raising/lowering rope; and 24, a counterweight provided on a rear end of the upper rotating body 2.

Both in the tower and normal cranes, when the booms 3, 4 are disassembled, the booms 3, 4 are first laid on the ground by the boom raising/lowering apparatus 11 as dash double dot lines show in FIGS. 1, 2.

Then, the boom raising/lowering rope 15 is loosened to lower the upper spreader 14 on a rear surface of the boom.

Behind a extreme end of the lowest boom 6 is provided a spreader retainer (bracket) 25. The upper spreader 14 is retained by the spreader retainer 25 with a pin to achieve an assembly/disassembly attitude which can secure the boom raising/lowering states, the boom guyline 16 is detached from the upper spreader 14, and the upper booms are then detached from the lowest boom 6 while boom raising/lowering action is property carried out.

After the disassembly, the base machine A and the lowest boom 6 are conveyed on a trailer while they are still in the assembly/disassembly attitude.

The assembly of the booms 3 and 4 is carried out by a procedure/operation inverse to that of the above disassembly.

Both in the tower and normal cranes, the minimum distance between both the lower and upper spreaders 13, 14 of the boom raising/lowering apparatus 11 (more precisely, the distance between the respective sheaves) is set as a distance which secures a fleet angle of the boom raising/lowering rope 15 equal to or lower than a certain angle.

In the present embodiment, the distance between both the lower and upper spreaders 13, 14 of the boom raising/lowering apparatus 11 is S1 for the maximum boom raising of the tower crane specification, and is S2 for the maximum boom raising of the normal crane specification, and the length of the lowest boom (distance between the center of the boom foot and the extreme end of the boom) is L. Both in the tower crane and normal crane specifications, S1, S2, and L are set such that the upper spreader 14 is lowered to the position of the spreader retainer 25 while the booms 3, 4 are laid on the ground by the boom raising/lowering apparatus 11 as shown in FIGS. 1 and 2.

For the tower crane specification, the maximum boom raise angle is approximately 90°. In this case, this angle is larger than that of the normal crane (approximately 80°), the amount of the winding for the boom is thus large, and both the spreaders 13, 14 are consequently the closest to each other. Therefore, the distance between the spreaders S1 on this occasion is set to a dimension which can secure the desired fleet angle.

Figure 3:
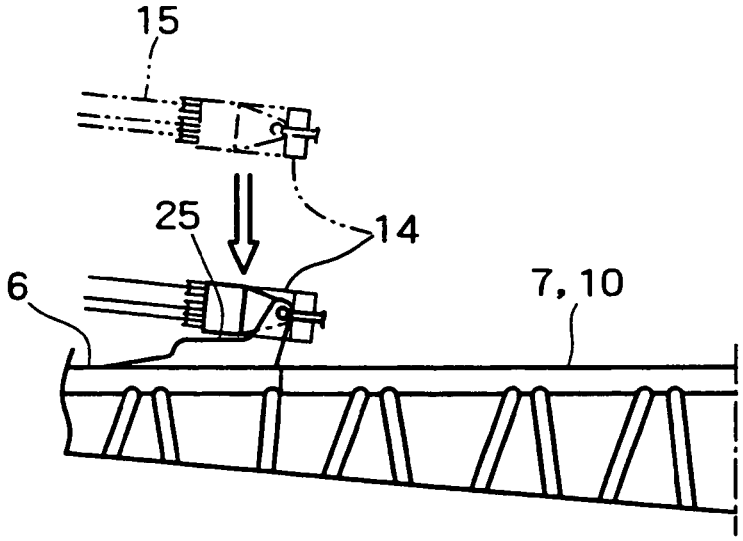
FIG. 3 describes a state where an upper spreader is lowered if a boom is disassembled for either of the cranes.

Based on this determined inter-spreader distance S1, the length of the lowest boom L (position of the spreader retainer 25) is determined such that the upper spreader 14 is directly lowered to the position of the spreader retainer 25 as shown in FIG. 3 if the boom raising/lowering rope 15 is loosened while the tower boom 3 is laid on the ground for the boom disassembly as shown in FIG. 1. In place of adjusting the length L of the lowest boom, the position of the spreader retainer 25 may be adjusted such that the upper spreader 14 is directly lowered to the position of the spreader retainer 25.

Also for the normal crane specification, the inter-spread distance S2 for the maximum boom raise is determined such that the upper spreader 14 is lowered to the position of the spreader retainer 25 as for the tower crane specification.

It is preferable S2 is determined to be larger than S1.

Compared with both of the crane specifications described in "THE RELATED ART" where the inter-spreader distances Sa and Sb are set as approximately equal to each other, S1 and S2 are set so as to satisfy the following conditions (i) to (iii). It is assumed that the length of the lowest boom 6 is La in "THE RELATED ART".

(i) S1 and Sa are approximately the same.

(ii) S2 is larger than Sa and Sb.

(iii) L is larger than La of the lowest boom 6 in "THE RELATED ART".

It should be noted that the relationship between S2 and Sb is shown in FIG. 2. in terms of the above condition (ii).

As a result of the setting described above, both on the tower and normal cranes, the upper spreader 14 can be directly lowered on the extreme end (spreader retainer 25) of the lowest boom 6, and can be retained by the spreader retainer 25 without the necessity of relocating the upper spreader 14 in the longitudinal direction of the boom 6.

Namely, for the tower crane, it is not necessary to relocate the upper spreader 14 lowered on the second boom 7 to the lowest boom 6 (spreader retainer 25) when the boom is disassembled, and to relocate the upper spreader 14 back when the boom is assembled as described in "THE RELATED ART".

Consequently, it is possible to eliminate the troublesome operation where the upper spreader 14 is relocated using another crane while the tension of the boom raising/lowering rope 15 is being observed for the assembly/disassembly of the boom.

In the crane according to the embodiment, the spreader retainer 25 on the lowest boom 6 is disposed at the position farther from the boom foot than that in "THE RELATED ART" as described above, and it is thus necessary to increase the length of the lowest boom 6 compared with that in "THE RELATED ART".

Consequently if the transport is simply carried out in the assembly/disassembly attitude on a trailer, the overall length will become longer. If this causes a problem, this problem may be solved by reducing the overall length of the upper rotating body 2 by an amount corresponding to the increase of the lowest boom, and increasing the weight of an upper section of the counterweight 24 by an amount corresponding to a resulting decrease in counter balance capability.

Although the invention has been described with reference to the preferred embodiment in the attached figures, it is noted that equivalents may be employed and substitutions made herein without departing from the scope of the invention as recited in the claims.

We claim:

1. A crane comprising:

a base machine;

a lower boom pivotedly attached to said base machine in such a manner that the lower boom may be raised and lowered;

a tower boom for a tower crane specification attachable to said lower boom to provide a tower crane;

a standard boom attachable to said lower boom to provide a standard crane having a maximum boom raising angle smaller than that of the tower crane;

a spreader retainer attached on a rear surface of the lower boom; and a boom raising/lowering apparatus that raises/lowers said tower boom or said standard boom, said boom raising/lowering apparatus comprising:

a gantry;

a lower spreader provided on a top of said gantry;

an upper spreader disposed closer to an extreme end of said tower boom or said standard boom than said lower spreader; and a boom raising/lowering rope wound between said upper spreader and said lower spreader, wherein the distance between both said spreaders is S1 when said lower boom is maximally raised for the tower crane, and S2 when said lower boom is maximally raised for the standard crane, the length of said lower boom is L, and S1, S2, and L are set such that said upper spreader is lowered to the position of said spreader retainer when said boom raising/lowering apparatus lays said lower boom on the ground for assembling/disassembling both said tower boom and said standard boom.

2. The crane according to claim 1, wherein the distance of S2 is larger than that of S1.

* * * * *